US005299393A

United States Patent [19]

Chandler et al.

[11] Patent Number: 5,299,393

[45] Date of Patent: Apr. 5, 1994

[54] SLURRY CONTAINMENT DEVICE FOR POLISHING SEMICONDUCTOR WAFERS

[75] Inventors: Willard F. Chandler, Byron; LaVerne B. Jacobson, Owatonna; Robert D. Johnson; Steven E. Monahan, both of Rochester, all of Minn.

[73] Assignee: Internation Business Machines Corporation, Armonk, N.Y.

[21] Appl. No.: 918,332

[22] Filed: Jul. 21, 1992

[51] Int. Cl.[5] ..... B24B 55/04; B24B 29/02

[52] U.S. Cl. ..... 51/272; 51/268; 51/318; 51/131.1

[58] Field of Search ..... 51/318, 317, 272, 268, 51/133, 132, 129, 131.1, 131.2, 131.3, 131.4

[56] References Cited

U.S. PATENT DOCUMENTS

| | | | |
|---|---|---|---|
| 2,466,610 | 4/1949 | Newman | 51/131.3 |
| 3,148,488 | 9/1964 | Reaser | 51/272 |
| 3,233,370 | 2/1966 | Best et al. | 51/131 |
| 3,377,750 | 4/1968 | Day | 51/131 |
| 3,457,682 | 7/1969 | Boettcher | 51/129 |
| 3,818,648 | 6/1974 | Evans | 51/268 |
| 4,043,081 | 8/1977 | DeTray | 51/129 |
| 4,216,629 | 8/1980 | DeGaeta | 51/131.2 |
| 4,481,741 | 11/1984 | Bouladon | 51/131.3 |
| 4,831,784 | 5/1989 | Takahashi | 51/131.3 |
| 4,891,915 | 1/1990 | Yasuda | 51/268 |
| 4,910,155 | 3/1990 | Cote | 51/90 |

OTHER PUBLICATIONS

P7872 E/45 SU 893-506, Mechan Autom Des Con 07.01.80-SU-865334.

*Primary Examiner*—Bruce M. Kisliuk
*Assistant Examiner*—Bo Bounkong
*Attorney, Agent, or Firm*—J. Michael Anglin

[57] ABSTRACT

Liquid abrasive slurry for chemical-mechanical polishing of semiconductor wafers is held on a rotating polish table by a containment device having two continuous circular bonded strips of differing flexibilities. A releasable clamp seals the entire length of the more flexible strip to the table periphery.

8 Claims, 2 Drawing Sheets

SLURRY CONTAINMENT DEVICE FOR POLISHING SEMICONDUCTOR WAFERS

BACKGROUND OF THE INVENTION

The present invention concerns chemical-mechanical polishing of semiconductor wafers or similar workpieces, and more particularly relates to a device for effectively containing an abrasive slurry on a rotating polish table.

In the conventional "chem-mech polish" (CMP) process, passivated semiconductor wafers are rotated against a polishing pad. A pH-controlled abrasive slurry introduced onto the rotating table maintains a proper etch rate of the passivation layer to achieve a very smooth planar surface on the wafers. U.S. Pat. No. 4,910,155 to Cote and Leach describes preferred procedures and materials for polishing semiconductor wafers; this patent also refers to other descriptions of "chem-mech" polishing methods.

In some CMP systems, the slurry flows continuously onto a flat polish table. As the table rotates, slurry is flung off the edge and carried away by a drain. This is wasteful of slurry material, leads to nonuniformity of the slurry at different locations, and splatters the abrasive slurry into surrounding machinery. In the Cote et al. patent, a raised wall of rectangular cross-section surrounds the table's edge. Such a wall or containment device must form a liquid-tight seal around the entire periphery of the polish table. Yet, at the same time, the wall must be easily removable in order to clean the polish table periodically, and must be quickly reinstallable on the table for setting up the next run with a new batch of slurry.

Conventional containment devices for CMP systems tend to be leaky, physically unwieldy, and difficult to install and remove. Some crude systems merely have as a wall, a thin plastic or metal band taped around the edge of a polish table. Large amounts of leakage occur in such systems, and cleaning the table between runs involves untaping and then replacing and resealing the entire wall. Another CMP apparatus uses a thick circular metal wall bolted at several points to counterbores in a flat polish table. Such a wall is bulky, but still weak and easily bent out of shape when removed from its polish table. Reinstallation for a new run requires accurate alignment and manipulation of a number of bolts. Leakage still occurs, however, between the table and the wall in the regions between the bolts.

SUMMARY OF THE INVENTION

The present invention provides an improved containment device for the chemical-mechanical polishing of semiconductor wafers and similar workpieces. The device effectively prevents leakage of liquid slurry from a polish table. It can be easily removed for cleaning and quickly reinstalled. It is light and yet not fragile or easily damaged. It is also extremely inexpensive and can be simply fabricated with common materials.

A containment device according to the invention has a circular continuous band of relatively stiff yet flexible material shaped to fit a polish table having a substantially circular periphery. Another circular continuous band of less stiff flexible material, capable of conforming closely to the table periphery, has a continuous, impermeable bond to the first band. A flexible clamp completely encircles the second band so as to force all of said inside surface of said second band tightly against the periphery of the table. The clamp has a release or latch for loosening said second band sufficiently to allow removal of the entire containment device from the table periphery.

Other objects and advantages of the invention, as well as modifications obvious to those skilled in the art, will appear in connection with the following detailed description of a preferred embodiment of the invention.

DESCRIPTION OF A PREFERRED EMBODIMENT

Figure 1:
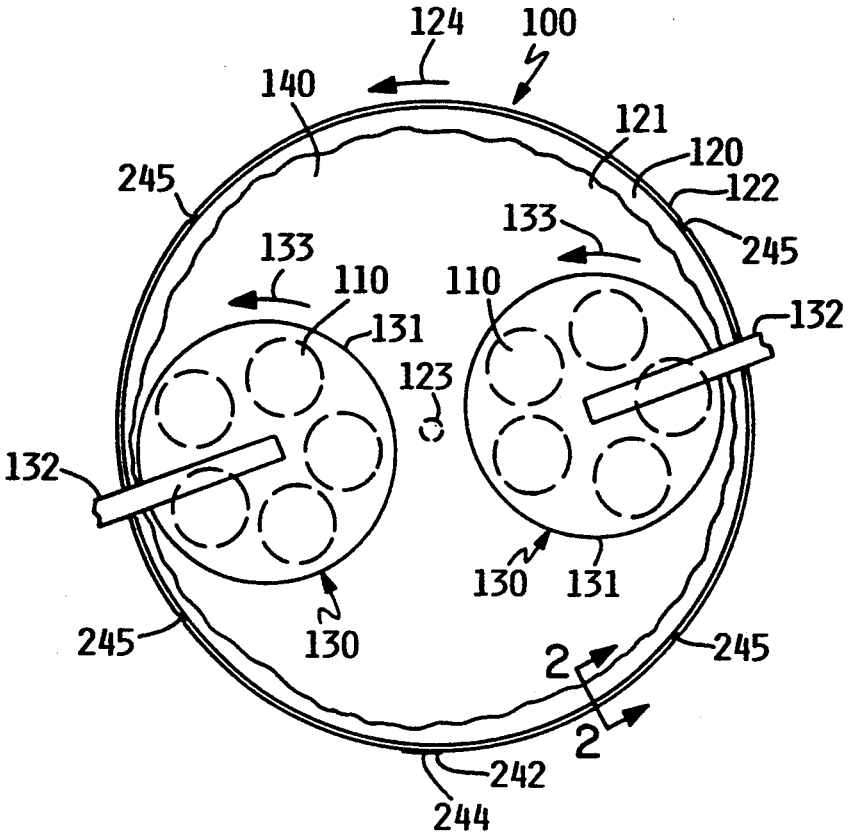
FIG. 1 a top view of a polishing apparatus for semiconductor wafers, incorporating the invention.

FIG. 1 illustrates apparatus 100 for chemical-mechanical polishing of semiconductor wafers such as 110 to achieve accurate planarization of their surfaces. Circular polish table 120 has a polishing pad 121 on its upper surface, and has a smooth circular periphery or edge 122. The polish table illustrated is 33" in diameter, 3" thick, and rotates at variable speeds between 0–200 rpm depending on the process. However, the containment device can be designed to fit the periphery of any table. The polishing pad used in this embodiment is a microporous, blown polyurethane material, though similar materials may also be used.

Drive spindle 123 rotates the table in the direction required for the process. Quill assemblies 130 hold and rotate wafers 110. Support carriers 131 hold the wafers on conventional elastomeric pads (not shown). Movable support arms 132 hold the wafers in contact with the polishing pad and carry gear drive means (not shown) for rotating the support carriers in the direction required for the process.

A pool of slurry 140, such as colloidal silica, is introduced to a depth of about 0.25", enough to cover polish pad 121 completely during rotation of the table 120. It is known in the art that using large amounts of slurry produces greater uniformity in the wafers, and prolongs the life of the polishing pad. However, the slurry periodically becomes contaminated; it must then be washed off the polish table and replaced with a fresh batch. Removable containment device or dam 200, the subject of the present invention, reliably holds large amounts of slurry on polish table 120 during a polishing run, yet is easily removed for cleaning the table, and easily replaced for the following run.

Figure 2:
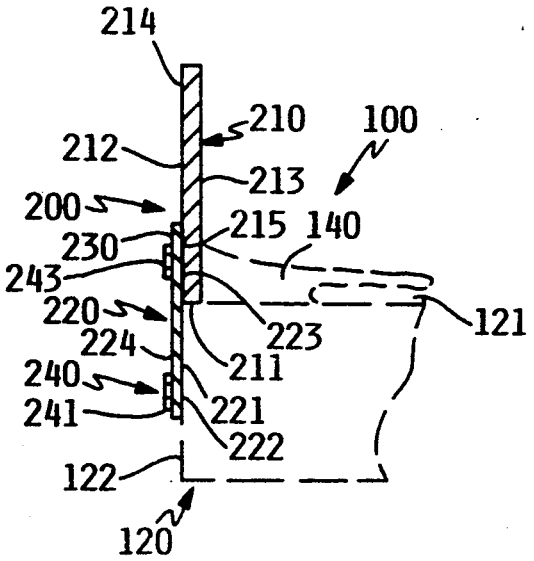
FIG. 2 shows a cross-section of the containment device of FIG. 1, taken along line 2—2 thereof.
Figure 3:
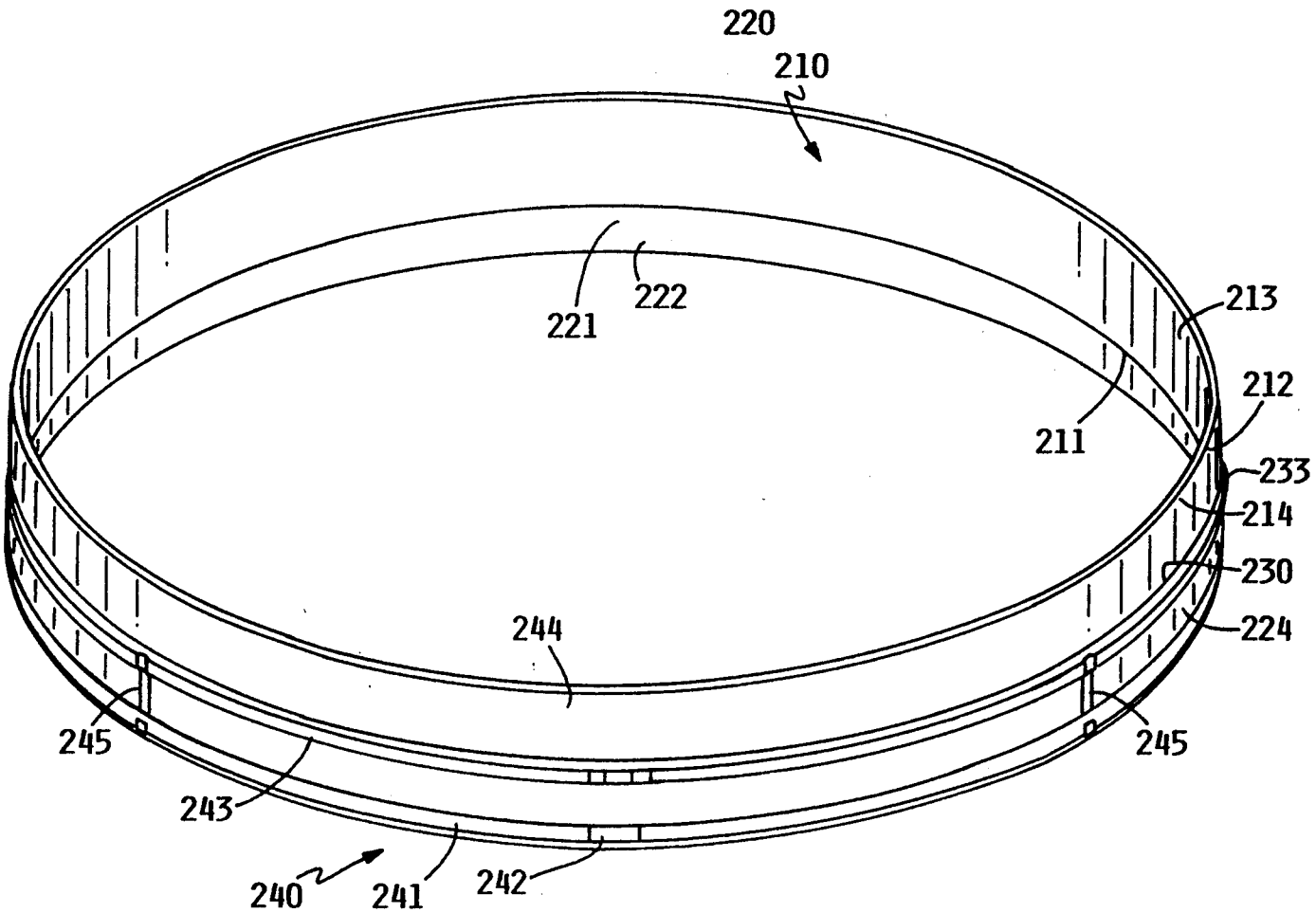
FIG. 3 is an isometric view of the containment device of FIGS. 1 and 2.

FIG. 2 shows a cross-section of the containment device or dam 200 of FIG. 1, taken along line 2—2 of FIG. 1; FIG. 3 shows an isometric view. A circular containment wall comprises a first continuous plastic band 210 having the same shape and size as the periphery 122 of polish table 120. Preferably, its lower edge 211 rests on the top of the table, with its outside surface 212 aligned with periphery 122 of the polish table. Its inside surface 213 then is in contact with slurry 140.

Band 210 is formed of a seamless strip of polypropylene, or other suitable material such as polyvinyl chloride (PVC), polyvinylidene fluoride (PVDF), or Teflon(tm). The band is relatively rigid, being only flexible enough to conform to the shape of the circular periphery of the polish table. The rigidity and shape of band 210 allows its upper area 214 to be freestanding, without any additional support. In this embodiment, band 210 is about 33" in diameter, 3" high, and 0.25" thick. The band's diameter and height are determined by the table diameter and height of tool design, which in this embodiment are 33" and 3" respectively.

A circular sealing boot comprises a second continuous plastic band 220, which may be a seamless strip of neoprene rubber or other suitable material, such as flexible PVC. Band 220, however, is made much more flexible than band 210. The inside surface 221 of band 220 conforms to the size and shape of polish table periphery 122, abutting it in a lower area 222 with a somewhat tight fit. An upper area 223 of inside surface 221 has a bond 230 to a lower area 215 of the outside surface 212 of the first band 210. In this embodiment, band 220 is about 33" in diameter, 2.5" high, and 0.125" thick.

Bond 230 may be a Locktite(tm) adhesive or other material such as PVC cement, which forms a continuous seal is impermeable to slurry 140. Various combinations of materials may be used for the bond 230, slurry 140, and bands 210 and 220, so long as all of the materials are compatible with one another and do not break down any of the other materials.

Clamp assembly 240 has a flat stainless steel ring 241 closely fitting the outside surface 224 of sealing boot 220. A conventional overcenter latch 242 tightens boot 220 around the periphery 122 of the polish table to provide a continuous seal around the entire periphery which is impermeable to the slurry material 140. Latch 242 could alternatively be a worm screw latch of the type used in aviation clamps, or some other conventional mechanism for releasably clamping boot seal 220 to the polish-table periphery. Ring 241 is attached or supported by flat tie strips 245, but it is not bonded to surface 224.

In addition, clamp assembly 240 has another flat stainless-steel ring 243 encircling both of the bands 210 and 220 in the region of the bond 230, above the surface of the polish table 120, as shown in FIG. 2. This second ring stabilizes the bond between bands 210 and 220, against any radial stresses or movement above ring 241 which might tend to loosen the seal of band 220 to band 210. Ring 243 is closed with a fixed closure 244; this ring need not be tightened and loosened. Flat tie strips 245 hold rings 241 and 244 at the desired spacing relative to each other. These strips may be tack welded or adhesively bonded to band 220 to support the two rings. Rings 241 and 243 are not bonded or fastened to the plastic bands 210 and 220. Ring 244 is tight enough to prevent the whole clamp assembly from sliding off the plastic bands.

In operation, containment device 200 is lowered over the periphery 122 of polish table 120 until lower edge 211 rests on the table. Latch 242 is then tightened to cause lower band 220 to form a liquid-tight seal around the entire periphery of the polish table. Slurry 140 is then introduced onto the top of the table, and the table 120 and quill assemblies 130 are rotated to planarize the semiconductor wafers 110. This may take 6–10 minutes or longer, depending on the process. Then the wafers are removed from the quill assemblies in a conventional manner. Thereafter, the process is monitored. When the measured uniformity degrades, the containment device 200 is removed so that the polish table can be washed for the next run. Device 200 is removed simply and easily by loosening latch 242 and raising the device off the top of the table.

In a lab environment having only two runs per day, slurry 140 may be changed only two or three times a week rather than every day. In a mass-production lab environment, where the slurry would normally be changed several times a day, this device would improve the slurry's uniformity, thereby requiring fewer changes.

What is claimed is:

1. A slurry containment device for a polishing apparatus having a flat table with a substantially circular periphery, comprising:

a circular continuous first band of relatively rigid material having a shape and size approximating said table periphery, said first band having an inside surface and an outside surface, each having an upper area and a lower area;

a circular continuous second band of flexible material capable of conforming closely to said table periphery, said second band having an inside surface and an outside surface, each of said last-named two surfaces having an upper area and a lower area;

a circular, continuous, impermeable bond sealing said lower area of one of said surfaces of said first band and said upper area of one of said surfaces of said second band;

clamp means completely encircling said lower area of said outside surface of said second band so as to force said lower area of said inside surface of said second band tightly against said circular periphery of said table;

release means included in said clamp means for loosening said second band sufficiently to allow removal from said table periphery.

2. A slurry containment device according to claim 1, wherein said bond is formed between said outside surface of said first band and said inside surface of said second band.

3. A slurry containment device according to claim 2, wherein said first band is shaped to fit above said table, inside said periphery.

4. A slurry containment device according to claim 1, wherein said clamp means comprises a flat, flexible ring encircling said lower area of said second band.

5. A slurry containment device according to claim 4, wherein said release means comprises an overcenter latch.

6. A slurry containment device according to claim 4, wherein said clamp means further comprises a second flat, flexible ring encircling said outside surface of said first band.

7. A slurry containment device according to claim 6, wherein said second ring encircles said lower are of said first ring, in the region of said bond.

8. A slurry containment device according to claim 6, wherein said clamp means further comprises a plurality of tie means for maintaining said first and second rings at a predetermined distance from each other.

* * * * *